US006958582B2

(12) United States Patent
Chou et al.

(10) Patent No.: US 6,958,582 B2
(45) Date of Patent: Oct. 25, 2005

(54) LAMP CURRENT CONTROL CIRCUIT

(75) Inventors: Chin-Wen Chou, Taipei Hsien (TW); Eddie Cheng, Taipei Hsien (TW); Kuang-Ming Wu, Taipei Hsien (TW)

(73) Assignee: Zippy Technology Corp., Taipei Hsien (TW)

( * ) Notice: Subject to any disclaimer, the term of this patent is extended or adjusted under 35 U.S.C. 154(b) by 31 days.

(21) Appl. No.: 10/799,726

(22) Filed: Mar. 15, 2004

(65) Prior Publication Data

US 2005/0200307 A1 Sep. 15, 2005

(51) Int. Cl.[7] ..... H05B 37/02

(52) U.S. Cl. ..... 315/291; 315/209 R; 315/307; 363/98

(58) Field of Search ..... 315/291, 245, 315/209 R, 307, 209; 363/98, 16; H05B 37/02

(56) References Cited

U.S. PATENT DOCUMENTS 4,723,096 A * 2/1988 Leighty ..... 315/254
4,958,108 A * 9/1990 Jorgensen ..... 315/307
6,566,821 B2 * 5/2003 Nakatsuka et al. ... 315/209 PZ
6,744,222 B2 * 6/2004 Kisaichi et al. ..... 315/291
6,804,129 B2 * 10/2004 Lin ..... 363/98
2002/0121865 A1 * 9/2002 Nakatsuka et al. ... 315/209 PZ
2005/0073859 A1 * 4/2005 Fukumoto ..... 363/16

* cited by examiner

*Primary Examiner*—Don Wong
*Assistant Examiner*—Binh Van Ho
(74) *Attorney, Agent, or Firm*—Birch, Stewart, Kolasch & Birch, LLP

(57) ABSTRACT

The present invention is a lamp current control circuit applied to a high voltage outputting combination for providing uniformity of lamp current of at least one load. Voltage dividing units of the lamp current control circuit receive high power signals output by the high voltage outputting combination and redistributes high power signals to lower power signals. A signal-processing unit receives the lower power signals distributed by the voltage-dividing units, compares the lower power signals with each other, and outputs the compensation power signal to the control unit. The compensation power signal is compared with a reference power signal of a variable unit, and a comparison power signal is output, thereby uniformly distributing the lamp current inside the load. For the above reason, it prevents power loss inside the load or damage to the load from abnormal lamp currents.

9 Claims, 4 Drawing Sheets

LAMP CURRENT CONTROL CIRCUIT

FIELD OF THE INVENTION

The present invention relates to a lamp current control circuit, and more particularly to a lamp current control circuit which redistributes high power signals as lower power signals, compares the lower power signals with each other, and then outputs a compensation power signal for uniformly distributing the lamp current inside the load.

BACKGROUND OF THE INVENTION

Recently, the necessary light source of a liquid crystal display (LCD) used in personal computers, notebook computers, personal digital assistants (PDA's) and web-pads utilizes a driving device to drive a load (e.g. a cold cathode fluorescent lamp) of a high voltage such that the light is emitted to a backlight plate and a user can clearly view a displayed image.

Particularly, an LCD TV or the LCD with a touch screen needs higher brightness to compensate for visual necessity. As the load is driven to a high voltage, the brightness is higher when the lamp current of the load is greater. In order to enhance brightness and uniformity, it is necessary to use a plurality of loads and simultaneously pay much attention to whether the lamp current is uniform or whether the error between the properties of the loads is small. Furthermore, the additional loads lead to increasing the number of driving units that drive the loads and increase the volume of a circuit board and difficultly of manufacture. Simultaneously, the manufacturing cost is increased. When the loads are utilized to compensate the brightness and uniformity, the lamp current and the brightness often are not uniform because of the error between the loads. Thus, it is difficult to select the loads or it is necessary to have more loads to improve the brightness and uniformity increasing the difficultly of manufacture and adjustment. Simultaneously, the manufacturing cost is increased. The lamp current control method according to the load is described as follows:

(1) A typical driving device t emits light and is shown in FIG. 1 includes a power unit 10, a control unit 11, a driving unit 12, a voltage step-up unit 13 and a load 14. When the power unit 10 is started up to input a voltage, the driving unit instantly drives the voltage step-up unit 13 by means of a converse and direct piezoelectric effect and then the voltage step-up unit 13 drives the load 14 to emit light. The control unit 11 outputs a resonant frequency to control the average current of the load 14 by sensing the feedback lamp current of the load 14, and therefore the generated light is emits behind the image display of a backlight plate. The voltage step-up unit 13 utilizes a push-pull type structure to drive the load 14, and the voltage step-up unit 13 is a ceramics transformer. However, the load 14 in the prior art often has problems, such as unstable electrode, gas, etc., such that the lamp current in the load 14 has abnormal behaviors (e.g. power loss). Although a feedback loop is connected to the control unit 11, the control unit 11 still cannot control the lamp current of the load 14 because the load 14 must be driven to emit the light in the high voltage. When the load 14 is driven to emit the light in the high voltage, the load 14 generates the lamp current with high energy to generate high frequency noises or arc light effect, etc. For above reason, it leads to the power loss inside the load 14 or the damage of the load 14.

(2) Referring FIG. 2, according to the problem show in FIG. 1, another prior art utilizes current control mode to sense the flow rate of the lamp current of the load 14. A current sensing unit 15 that consists of current generators in series connection sensing current signals of the load 14, then processing comparisons between two voltage drops through a signal processing unit 16 to generate a compensating signal which is fed back to the control unit 11. There must be a plurality of short lamp in series connection applied in the prior art shown in FIG. 2, but a single long lamp is not suitably applied in the prior art shown in FIG. 2. In addition, the current sensing unit 15 must be disposed around the load 14 in the prior art shown in FIG. 2, such that the end of the load 14 has low brightness that becomes lower than before. For the above reason, a dark point is displayed, and is generated by the location of the current sensing unit 15.

Accordingly, there exists a need for a lamp current control circuit to solve the above-mentioned problems and disadvantages.

SUMMARY OF THE INVENTION

It is an object of the present invention to provide a lamp current control circuit applied in a high voltage outputting combination for providing uniformity of lamp current of at least one load, wherein the load can be a cold cathode fluorescent lamp with long or short dimension.

The above-mentioned high voltage outputting combination includes a control unit, driving units, voltage step-up units, and the load. The lamp current control circuit includes voltage dividing units and a signal-processing unit.

The voltage-dividing units is disposed at the output ends of the voltage step-up units, wherein the voltage dividing units receive high power signals generated by the load, distributes the high power signals to lower power signals, and then outputs the lower power signals.

The signal-processing unit receives the lower power signals distributed by the voltage-dividing units, compares the lower power signals with each other, outputs the compensation power signal to the control unit, and then processes the redistribution of voltage for uniformly distributing the lamp current inside the load.

According to the abnormal lamp current caused by the effect of the high power signals of the high voltage outputting combination, the present invention is characterized in that the voltage dividing units receive high power signals output by the high voltage outputting combination and redistributes t as lower power signals, and the signal processing unit receives lower power signals distributed by the voltage dividing units, compares them and outputs the compensation power signal to the control unit, it then processes the redistribution of voltage, thereby uniformly distributing the lamp current inside the load. For the above reason, it prevents power loss inside the load or damage to the load from abnormal lamp currents.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENTS

Figure 1:
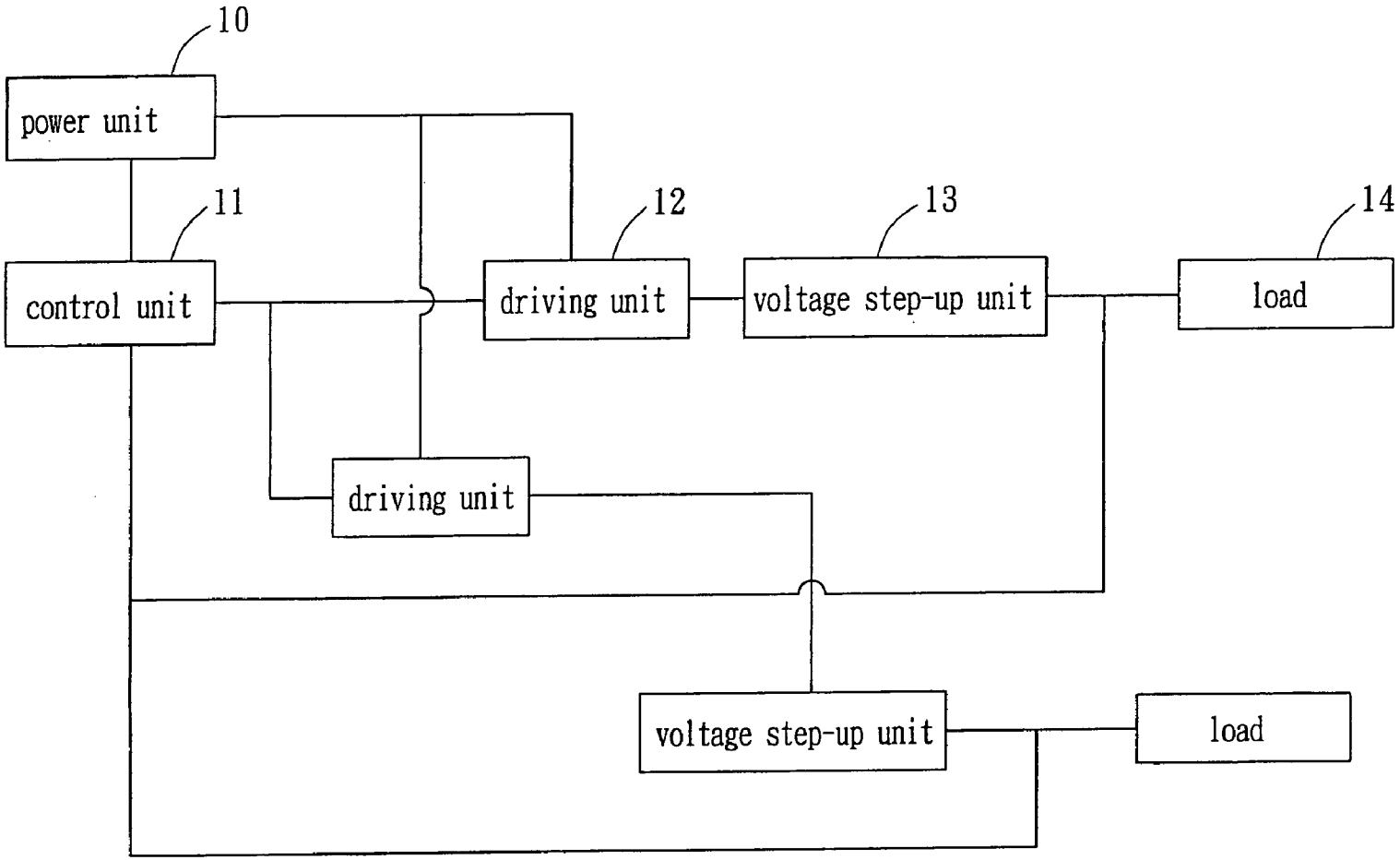
Fig. 1 PRIOR ART
FIG. 1 is a simplified schematic diagram of a current control circuitry in the prior art.
Figure 2:
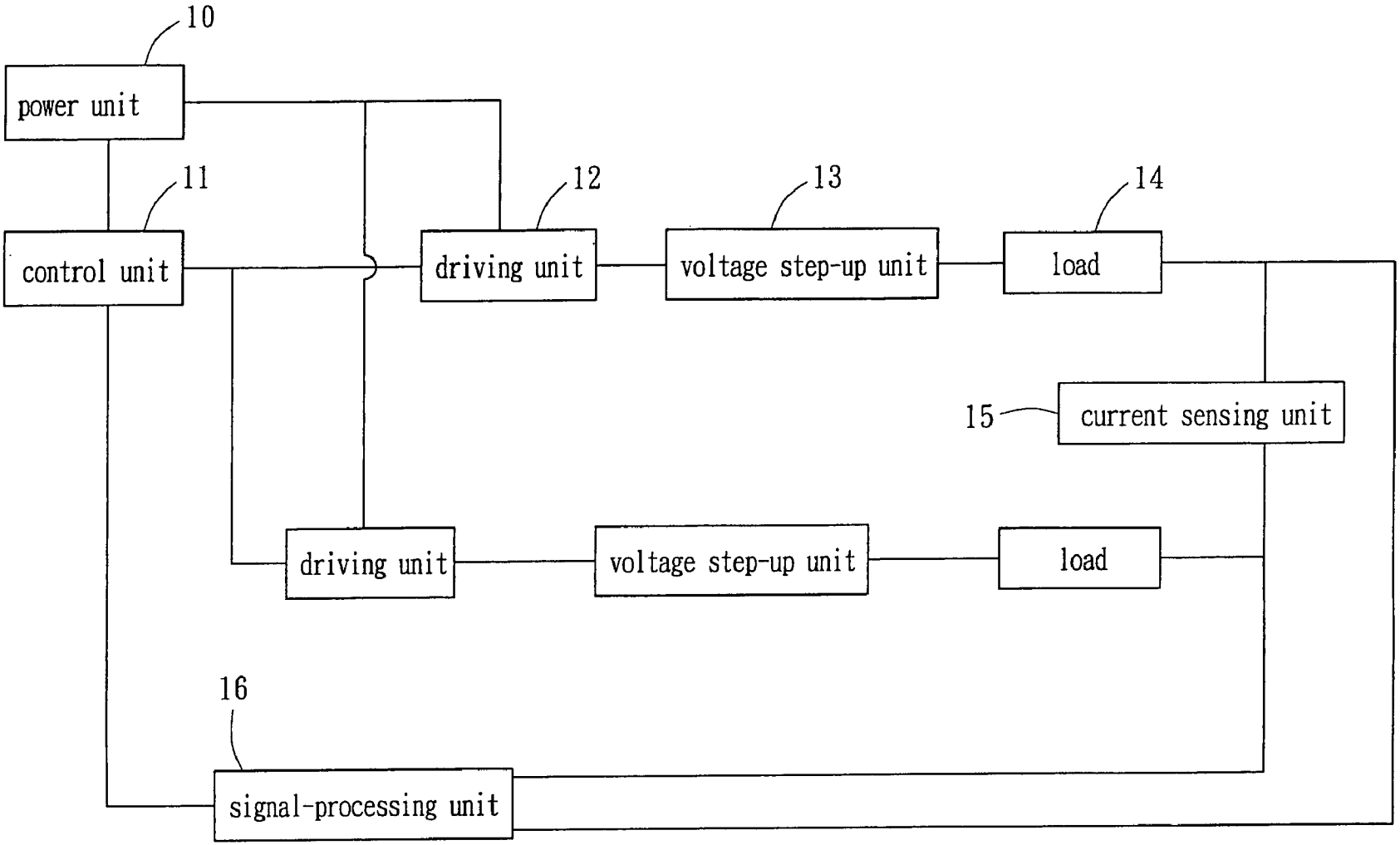
Fig. 2 PRIOR ART
FIG. 2 is a simplified schematic diagram of another current control circuitry in the prior art.
Figure 3:
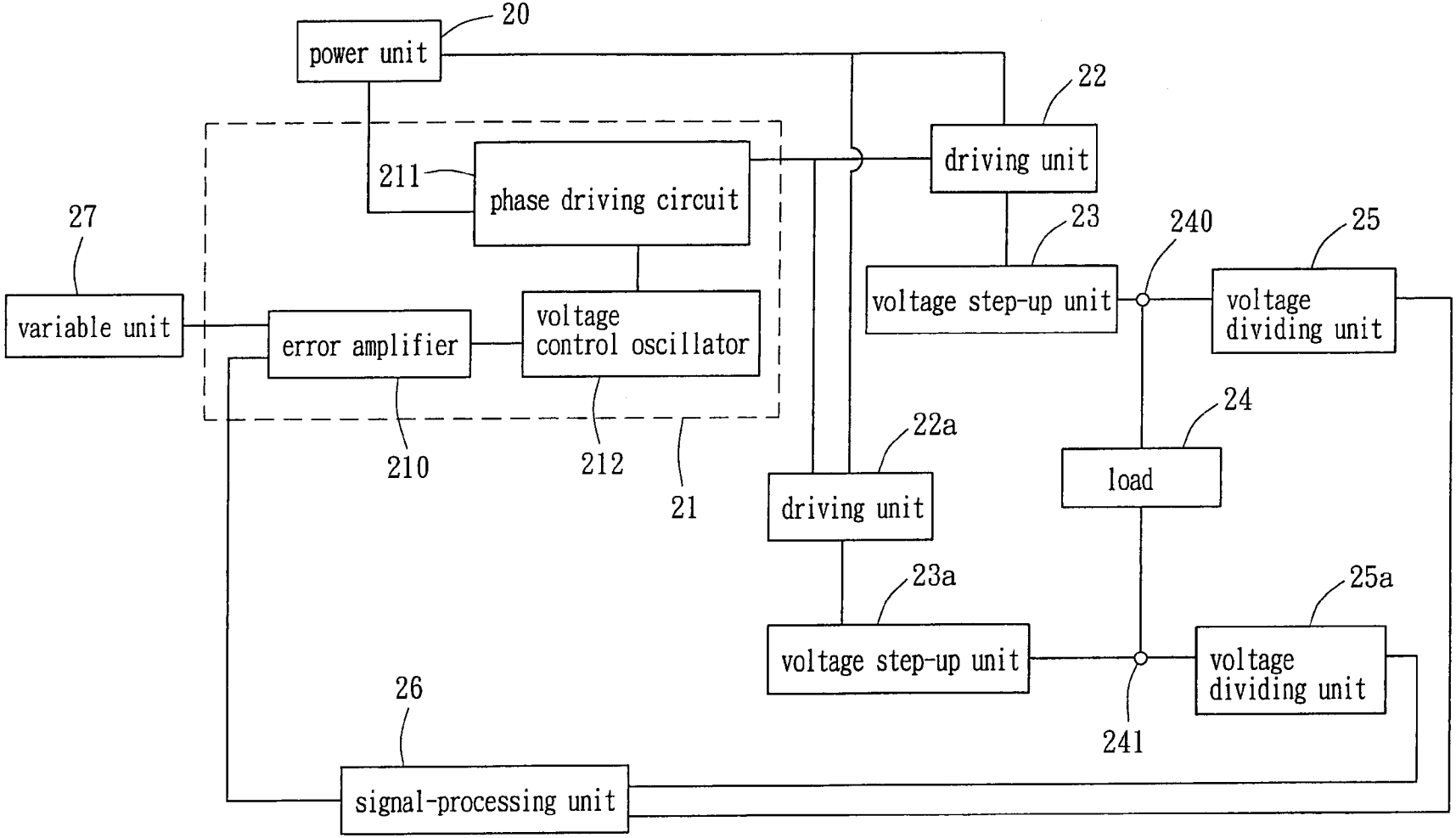
FIG. 3 is a simplified schematic diagram of a current control circuitry according to the first embodiment of the present invention.

The first embodiment:

Referring to FIG. 3, it depicts a simplified schematic diagram of a current control circuitry according to the first embodiment of the present invention. A lamp current control circuit which is disclosed in the first embodiment controls the normal action of the lamp current inside a load 24 (the load 24 is a cold cathode fluorescent lamp with long dimension) and prevents abnormal behavior of the lamp current inside a load 24 from the unusual phenomenon of a high voltage outputting combination. The high voltage outputting combination includes a control unit 21 which provides voltage distributing signals, driving units 22, 22*a* which receives the voltage distributing signals to convert voltage into high voltage outputting ends 240, 241, voltage step-up units 23, 23*a*, and a load 24 which is connected to the high voltage outputting ends 240, 241. The above-mentioned voltage step-up unit 23, 23*a* utilizes a push-pull type structure to drive the load 24, and the voltage step-up unit 23, 23*a* is a ceramics transformer. The lamp current control circuit is characterized in that:

the lamp current control circuit is disposed between the high voltage outputting ends 240, 241 of the voltage step-up unit 23, 23*a* and the control unit 21 for distributing high power signals to low power signals, processing differential comparison, then outputting a compensation power signal to the control unit 21, and processing the redistribution of voltage.

The lamp current control circuit includes two voltage-dividing units 25, 25*a*, and a signal-processing unit 26.

The voltage dividing units 25, 25*a*, are a voltage dividing circuit which is constituted by a plurality of impedance elements, and are disposed at the high voltage outputting ends 240, 241 of the voltage step-up units 23, 23*a*, wherein the above-mentioned high voltage outputting combination outputs a high power signal and drives the load 24 (e.g. the cold cathode fluorescent lamp with long dimension) to emit the light and the voltage dividing units 25, 25*a* distribute the high power signals to lower power signals and then output the lower power signals.

The signal processing unit 26 is a voltage differential amplifier or a full-wave rectifier, receives the lower power signals which are distributed by the voltage dividing units 25, 25*a*, compares the lower power signals with each other, and then outputs a compensation power signal to the control unit 21 (the control unit 21 has an error amplifier 210, a phase driving circuit 211 and a voltage control oscillator 212). The signal-processing unit 26 is compared with a variable unit 27. The variable unit 27 is a variable potential or a variable resistance for providing a reference power signal and outputting the reference power signal to the control unit 21. The error amplifier 210 compares the compensation power signal with the reference power signal, outputs a comparison power signal, and then outputs a resonant frequency through the voltage control oscillator 212 and the phase driving circuit 211 for uniformly distributing the lamp current of the load 24. For the above reason, it prevents power loss inside the load 24 or damage to the load 14 from abnormal lamp currents.

Figure 4:
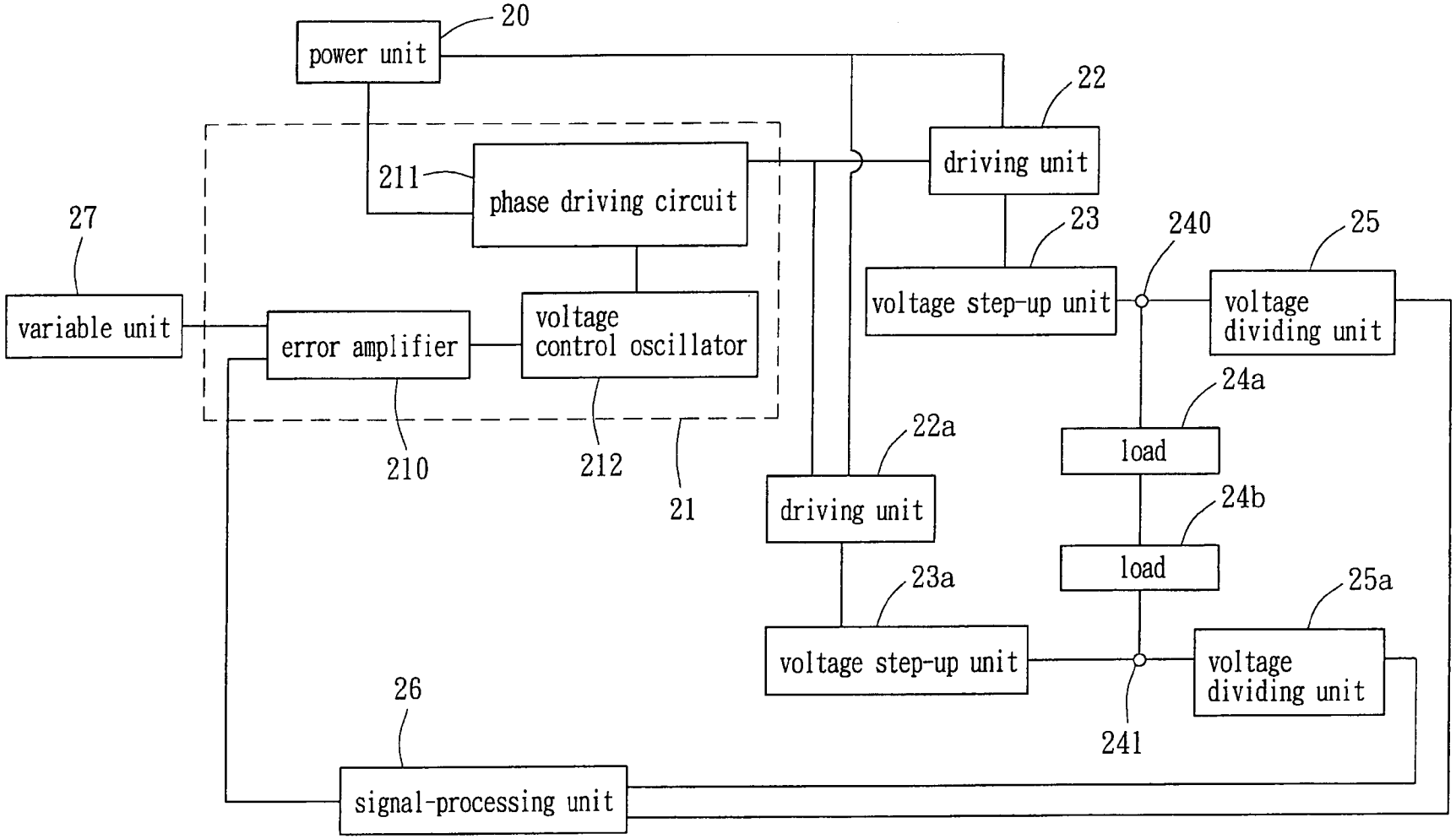
FIG. 4 is a simplified schematic diagram of a current control circuitry according to the second embodiment of the present invention.

The second embodiment:

Referring to FIG. 4, depicts a simplified schematic diagram of a control circuitry according to the second embodiment of the present invention. A lamp current control circuit which is disclosed in the second embodiment controls the normal action of the lamp current inside two loads 24*a*, 24*b* (the loads 24*a*, 24*b* are cold cathode fluorescent lamps with short dimension), wherein the loads 24*a*, 24*b* are connected in series (shown in FIG. 4). The lamp current control circuit in the second embodiment includes two voltage dividing units 25, 25*a* that receive high power signals generated by the above-mentioned loads 24*a*, 24*b* and redistributes high power signals to lower power signals, a signal processing unit 26 which receives the above-mentioned low power signal and compares the lower power signal of the voltage dividing units 25 with the lower power signal of the voltage dividing units 25*a*, and a variable unit 27 which provides a reference power signal, wherein the lamp current control mode of the loads 24*a*, 24*b* (e.g. the cold cathode fluorescent lamps with short dimension) in the first embodiment is same as the lamp current control mode of the loads 24 (e.g. the cold cathode fluorescent lamps with long dimension) in the second embodiment.

Although the invention has been explained in relation to its preferred embodiment, it is not used to limit the invention. It is to be understood that many other possible modifications and variations can be made by those skilled in the art without departing from the spirit and scope of the invention as hereinafter claimed.

What is claimed is:

1. A lamp current control circuit applied in a high voltage outputting combination for providing uniformity of lamp current of at least one load, the high voltage outputting combination including a control unit providing voltage distribution signals, driving units to receive the voltage distributing signals to convert a voltage into high voltage outputting ends, voltage step-up units, and the load connected to the high voltage outputting ends, the lamp current control circuit characterized in that:

the lamp current control circuit is disposed between the high voltage outputting ends of the voltage step-up unit and the control unit for redistributing high power signals as low power signals, processing the low power signals, outputting a compensation power signal to the control unit, and then processing the redistribution of voltage.

2. The lamp current control circuit according to claim 1, comprising:

at least two voltage dividing units being a voltage dividing circuit consisting of a plurality of impedance elements disposed at the high voltage outputs of the voltage step-up units; and a signal processing unit receiving the lower power signals distributed by the voltage dividing units, comparing the lower power signals with each other, and then outputting the compensation power signal to the control unit.

3. The lamp current control circuit according to claim 2, wherein the signal-processing unit is compared with a variable unit provided with a reference power signal in advance.

4. The lamp current control circuit according to claim 3, wherein the signal-processing unit is a voltage differential amplifier.

5. The lamp current control circuit according to claim 3, wherein the signal-processing unit is a full-wave rectifier.

6. The lamp current control circuit according to claim 3, wherein the variable unit is a variable resistor.

7. The lamp current control circuit according to claim 2, wherein the control unit including an error amplifier receives and compares the compensation reference power signals and, outputting a comparison power signal; a phase driving circuit receiving the comparison power signal; and a voltage control oscillator outputting a resonant frequency.

8. The lamp current control circuit according to claim 1, wherein the load is a lamp with a long dimension.

9. The lamp current control circuit according to claim 1, wherein the loads are two lamps with a short dimension.

* * * * *